US009480340B1

(12) United States Patent
Harlow

(10) Patent No.: US 9,480,340 B1
(45) Date of Patent: Nov. 1, 2016

(54) SYSTEMS AND METHODS FOR PROVIDING ERGONOMIC EXERCISE CHAIRS

(71) Applicant: Corecentric LLC, Fort Lauderdale, FL (US)

(72) Inventor: Bryce Harlow, Fort Lauderdale, FL (US)

(73) Assignee: Corecentric LLC, Fort Lauderdale, FL (US)

( * ) Notice: Subject to any disclaimer, the term of this patent is extended or adjusted under 35 U.S.C. 154(b) by 274 days.

(21) Appl. No.: 14/029,189

(22) Filed: Sep. 17, 2013

(51) Int. Cl.
*A47C 7/44* (2006.01)
*A47C 1/022* (2006.01)
*A47C 7/00* (2006.01)

(52) U.S. Cl.
CPC ..... *A47C 7/44* (2013.01); *A47C 1/022* (2013.01); *A47C 7/00* (2013.01)

(58) Field of Classification Search
USPC ..... 297/296–298, 301.1, 302.1, 452.21, 297/452.23, 452.25
See application file for complete search history.

(56) References Cited

U.S. PATENT DOCUMENTS 4,889,387 A * 12/1989 Gregory ..... A47C 7/022 297/452.27
5,044,633 A * 9/1991 Rice ..... 482/138
5,577,804 A 11/1996 Tedesco
5,718,476 A 2/1998 De Pascal et al.
5,908,221 A 6/1999 Neil
6,092,871 A 7/2000 Beaulieu
6,092,872 A 7/2000 Beaulieu
6,168,237 B1 1/2001 Lamart et al.
6,257,668 B1 * 7/2001 Chou ..... 297/411.32
6,572,190 B2 6/2003 Koepke et al.
6,709,058 B1 3/2004 Diffrient
6,755,467 B1 6/2004 Chu
6,799,803 B1 10/2004 Lee et al.
6,811,218 B2 11/2004 Hasenour et al.
6,848,744 B1 2/2005 Raftery et al.
7,025,424 B2 4/2006 Harley
7,040,703 B2 * 5/2006 Sanchez ..... 297/353
7,195,583 B2 3/2007 Leib
7,216,388 B2 * 5/2007 Bieganek ..... A47C 7/022 297/452.26
7,322,907 B2 1/2008 Bowser
7,416,251 B2 8/2008 Chu
7,475,946 B2 1/2009 Diffrient
7,712,833 B2 5/2010 Ueda
7,841,665 B2 11/2010 Geister et al.
7,874,619 B2 1/2011 Harley (Continued)

FOREIGN PATENT DOCUMENTS

WO WO-2012044010 4/2012

OTHER PUBLICATIONS http://www.teknion.com/products/seating_rbt/default.asp?country=us, last accessed Nov. 11, 2013, pp. 1-3.

(Continued)

*Primary Examiner* — Sarah McPartlin
(74) *Attorney, Agent, or Firm* — RegitzMauck PLLC

(57) ABSTRACT

A chair for providing seating support to a user and for providing ways for the user to perform exercises. The chair includes a back support that is flexible such that when a force is applied to it by the user's body, the back support bends. The back support may be configured to adapt to the curvature of the user's spine when the user is seated in the chair. The back support may further be configured such that the user can rotate the back support by rotating the user's upper body.

31 Claims, 18 Drawing Sheets

(56) References Cited

U.S. PATENT DOCUMENTS

| | | | | |
|---|---|---|---|---|
| 7,909,402 | B2 * | 3/2011 | Chu | A47C 7/405 297/284.1 |
| 7,963,609 | B2 | 6/2011 | Jinkun | |
| 7,980,631 | B2 | 7/2011 | Diffrient | |
| 7,998,045 | B2 | 8/2011 | Splane | |
| 8,104,837 | B2 | 1/2012 | Diffrient | |
| 8,162,402 | B2 * | 4/2012 | Yamauchi | 297/452.48 |
| 8,439,442 | B2 * | 5/2013 | Highlander | 297/313 |
| 8,696,534 | B2 * | 4/2014 | Karwan | 482/145 |
| 8,905,906 | B2 * | 12/2014 | Man | 482/142 |
| 8,944,977 | B2 * | 2/2015 | Foster | 482/137 |
| 8,967,724 | B2 | 3/2015 | Battey et al. | |
| 9,004,597 | B2 | 4/2015 | Battey et al. | |
| 9,010,859 | B2 | 4/2015 | Battey et al. | |
| 2002/0117883 | A1 * | 8/2002 | Gevaert | 297/291 |
| 2004/0140701 | A1 * | 7/2004 | Schmitz | A47C 7/44 297/284.4 |
| 2011/0266853 | A1 | 11/2011 | Zhou | |
| 2013/0005550 | A1 | 1/2013 | Nagy | |
| 2013/0045845 | A1 | 2/2013 | Verheem | |
| 2013/0169016 | A1 * | 7/2013 | Meyuhas | 297/313 |

OTHER PUBLICATIONS

Teknion RBT (product brochure), http://www.teknion.com, pp. 1-18.

http://www.gymygym.com/how-it-works, last accessed Aug. 29, 2013.

http://www.gymygym.com/back-exercises/upright-row, last accessed Aug. 29, 2013.

http://www.gymygym.com/back-exercises/lat-pull, last accessed Aug. 29, 2013.

http://www.gymygym.com/back-exercises/back-extension, last accessed Aug. 20, 2013.

http://www.gymygym.com/core-exercises/ab-workout, last accessed Aug. 29, 2013.

http://www.teknion.com/products/seating_visio/default.asp?country=canada&section=seating&subsection=works&product=visio, last accessed Aug. 29, 2013.

http://www.hermanmiller.com/products/seating.html, last accessed Aug. 29, 2013.

"Shadow—True Response Support System," Brochure, Feb. 2, 2012, Global U.S.A.

* cited by examiner

SYSTEMS AND METHODS FOR PROVIDING ERGONOMIC EXERCISE CHAIRS

TECHNICAL FIELD

The present invention relates generally to chairs and, more specifically, to chairs such as residential and office chairs that provide exercise features to a user in addition to seating support that promotes proper posture.

BACKGROUND OF THE INVENTION

Maintaining proper health, fitness and physical appearance are major concerns for many people today. However, in many countries, a large section of the population have sedentary jobs. To compound this, many are unable to find the time to exercise because they spend so much time at these sedentary jobs. The typical office worker, for example, is confined to his or her desk about 7.5 hours per day.

In the United States, statistics paint a bleak picture with respect to present day sedentary lifestyles. For example, about 36% of Americans are obese and, with respect to the future working population, one out of three persons under 18 years of age is obese. A significant portion of the United States' medical costs is incurred in treating diseases associated with obesity. At first blush, it may seem that many persons address their lack of exercise on the job by working out at gyms. But only about 15% of Americans have gym membership and only about 10% of those who have membership use it.

Sitting for long periods without exercise can have significant negative effects on the body. For example, headaches, mental fatigue, stress related tension in the shoulders and accumulation of fluids in the lungs and neck are some of the consequences of sitting for long periods without exercise. One section of the body that is especially susceptible to this is the back. With respect to the back, sitting for long periods without exercise can cause back muscle imbalance, weakness, loss of flexibility, pain, arthritis, sciatica, degenerative disc disease and the like.

Poor posture while sitting is a further issue associated with the modern day sedentary life style. As noted above, sitting for long periods without exercise in and of itself is an health issue, but poor posture complicates this further. Examples of bad sitting posture include a person reclining too much in a chair or leaning out of the chair such that there is no support for the person's back. Currently, chair design is focused on providing proper back support from the pelvis sacrum region and the lumbar region of the back.

The problems presented by the modern day sedentary lifestyle is of growing concern. At least one city in the United States has considered this issue and has issued guidelines to address it. Specifically, the city of New York has issued "Active Design Guidelines" for designing office space to address obesity and its related diseases. The guidelines seek to provide architects and designers with approaches for designing urban spaces and healthier buildings. For example, the new designs place stairwells in convenient locations so that workers will use the stairs more often. Although buildings are now being designed to facilitate healthier lifestyles, generally, the furniture used in buildings are not designed to facilitate the healthier lifestyle desired by many today.

BRIEF SUMMARY OF THE INVENTION

The present invention is directed to systems and methods that provide chairs that change the support provided to a user based on the posture of the user sitting in the chair. The chairs are also configured to have mechanisms that the user can use to perform exercises. Some of the mechanisms on the chair may have dual functions such that when the chair is being used for seating support the mechanisms perform one function and when they are being used as a tool for exercise they perform another or additional function.

Embodiments of the invention include a chair that provides proper support for a user's back. For example, embodiments may provide a chair with a back support that bends at least at a section of the back support that is at a level higher than a level of the seat. The bending occurs in response to force from the user when the user sits in the chair. The flexibility of the back support may be provided by a flexible chair spine that adapts to the curvature of the user's spine.

Embodiments of the invention include a chair that has a flexible back support that serves as a mechanism for a user to perform exercises. The flexibility in the back support that engenders this exercise feature may be provided by a flexible chair spine.

Embodiments of the invention include a chair having a back support connected to a seat such that an upper surface of the seat includes gaps in support provided to the user. The gaps in support may be adapted to be beneath the user's spine to reduce pressure on the "tail" of the spine and on the user's ischial tuberosities. Further, the upper surface of the seat may be sloped downwards from the back support towards the front of the chair to facilitate proper posture of the user's back and, in particular, spine.

Embodiments of the invention include a chair for supporting a user and for use in the user performing exercises. The chair may include a base that has foot restraints for restraining movement of the user's feet during the performance of the exercises.

According to embodiments of the invention, a user is provided with an ergonomic exercise chair that helps the user stay fit and healthy. Specifically, the user has at his or her disposal, a chair that encourages proper posture and may be used while in the office, while working, and during work breaks to do exercises throughout a working day. In this way, the user is able to exercise without gym membership and despite the lack of time to do exercises outside of the office. As such, the user may more easily maintain health and fitness and do so at low cost. These benefits to the user may accrue to the user's employer because a happier and healthier employee is more productive, less prone to be absent from work due to sickness, and would incur less health insurance related costs.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For amore complete understanding of the present invention, reference is now made to the following descriptions taken in conjunction with the accompanying drawing, in which.

DETAILED DESCRIPTION OF THE INVENTION

Figure 1A:
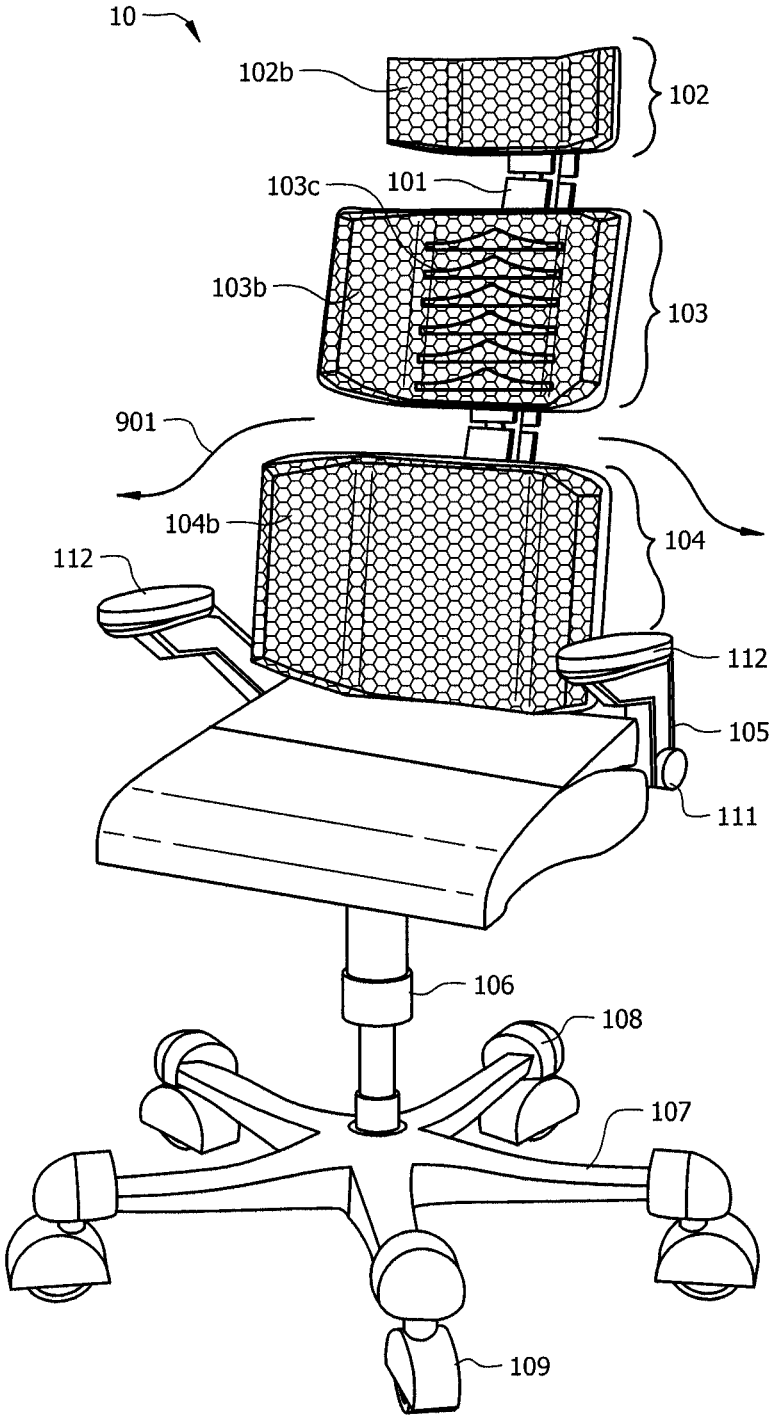
FIGS. 1A and 1B show a chair according to embodiments of the invention.
Figure 1B:
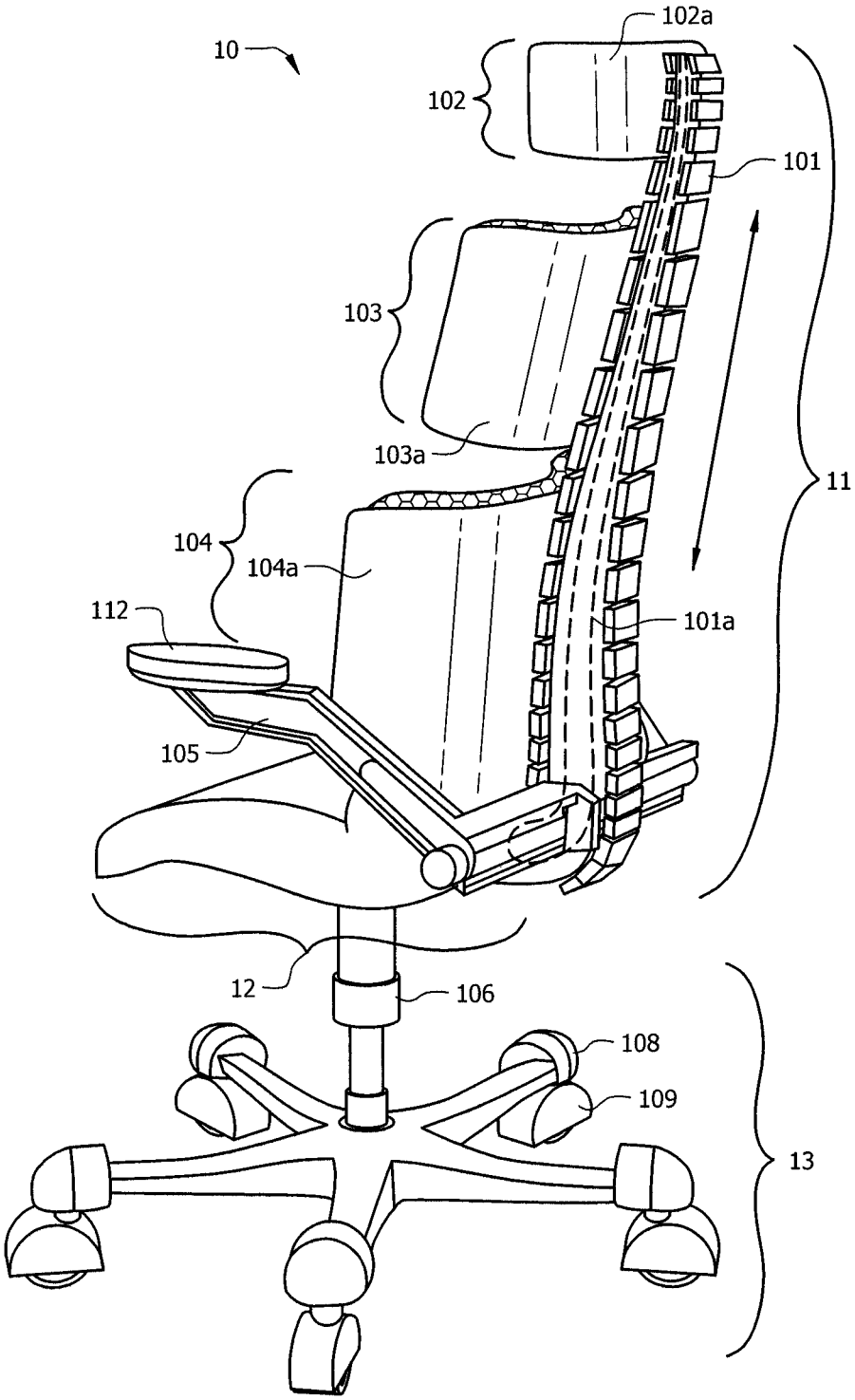

FIGS. 1A and 1B show a chair according to embodiments of the invention. As shown, chair 10 includes chair back support 11, seat 12 and base 13. Chair back support 11 is shown as including flexible chair spine 101, headrest 102, shoulder support 103 and lower back support 104. The outer portion of headrest 102 may include back 102*a* (made of plastic, metal, the like or combinations thereof) with an inner layer 102*b* that would be in contact with the head of user 110 when user 110 is seated in chair 10. Inner layer 102*b* may be made of mesh or fabric or the like and may be connected to back 102*a* by materials such as glue etc. Inner layer 102*b* may also include egg crate memory foam material. It should be noted that in some chair embodiments, no headrest is present.

Chair back support 11 includes flexible chair spine 101. As shown in FIG. 1B, flexible chair spine 101 may be oriented in a substantially vertical plane while seat 12 is oriented in a substantially horizontal plane. As used herein, substantially with respect to a particular plane means planes within 5° of the particular plane. Flexible chair spine 101 may be connected to seat 12 by various methods such as by bolting etc. To provide uniform support to a user's back, flexible chair spine 101 may be connected to a vertical center line of headrest 102, shoulder support 103 and lower back support 104 as shown in FIGS. 1A and 1B. As such, in embodiments, a portion of each of headrest 102, shoulder support 103 and lower back support 104 is located to the left or right of flexible spine 101. In this way, the left portions of headrest 102, shoulder support 103 and lower back support 104 may be a mirror image of the respective right portions of headrest 102, shoulder support 103 and lower back support 104. It should be appreciated that flexible spine 101 could be implemented as a plurality of elements in back support 11 that are connected to headrest 102, shoulder support 103 and lower back support 104.

Flexible chair spine 101 is flexible and may be made of plastic, fiber glass, carbon fiber etc. so as to allow chair spine 101 to expand and contract depending on user 110's movement forward or backward in chair 10. Flexible chair spine 101 supports the back of user 110. However, flexible chair spine 101 is flexible enough such that when user 110 leans backwards with a sufficient force it flexes backwards. In embodiments, a force of 20-70 pounds is sufficient to cause flexible chair spine 101 to bend backwards. In some embodiments, this force is limited to 20-40 pounds. When the force is removed, spine 110 returns to its previous non-bent configuration. Flexible chair spine 101 may be made from materials such as Hytrel Thermoplastic, which can be bent, flexed, twisted, compressed, turned, and squeezed. The Hytrel Thermoplastic material gives flexible chair spine 101 an "elastic design." In this way, flexible chair spine 101 is capable of adjusting to the body of a user in a manner such that it follows the curvature of the user's back and spine. In embodiments, the flexibility may be varied by varying the tension in tension wires 101*a* disposed in chair spine 101.

Figure 2A:
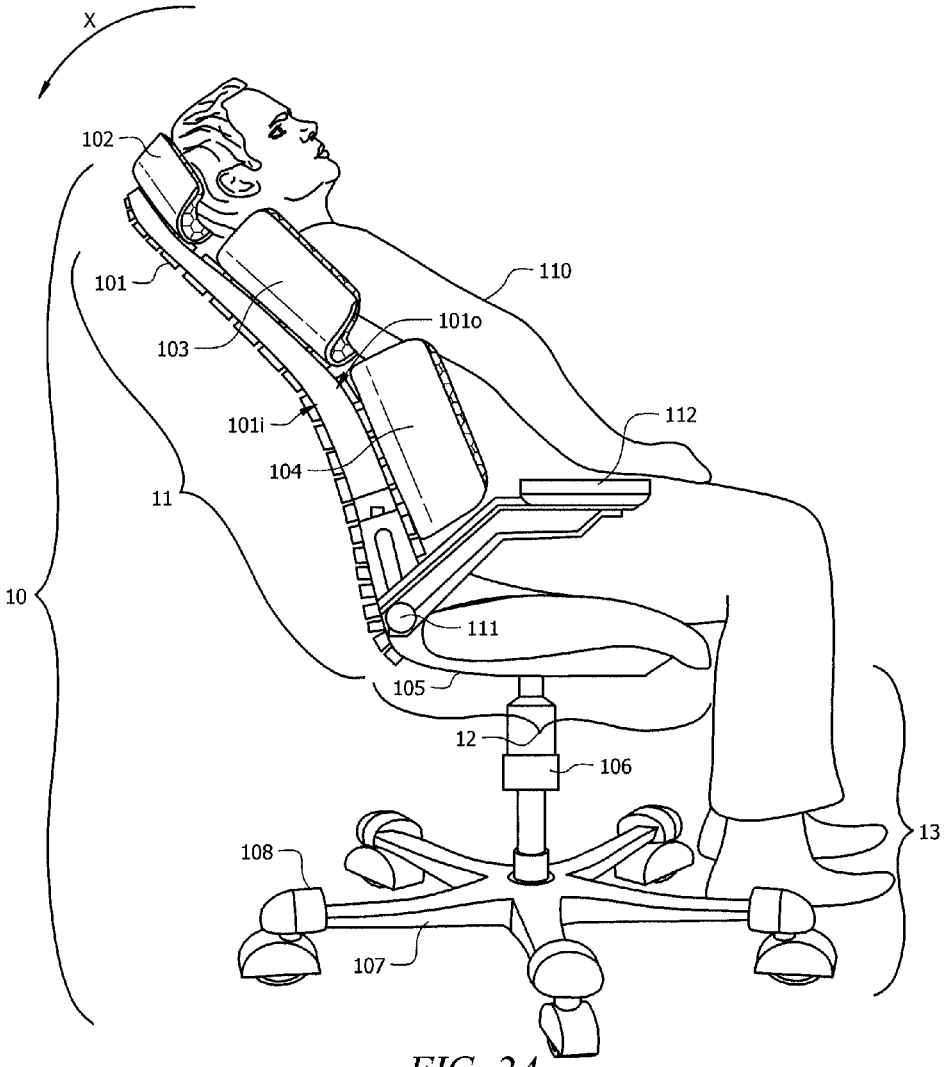
FIGS. 2A and 2B show a chair according to embodiments of the invention.
Figure 2B:
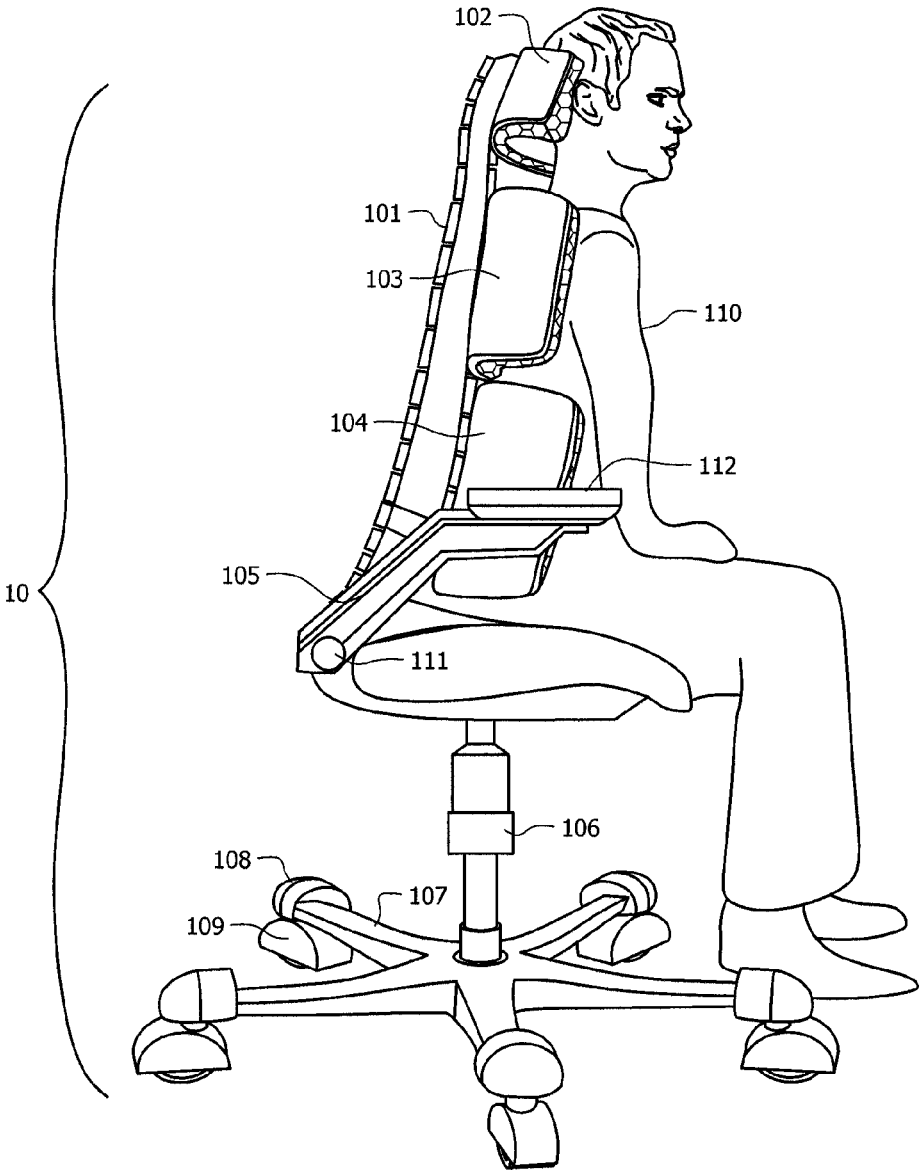

FIGS. 2A and 2B illustrate chair 10 adapting to accommodate different seating postures of user 110. In FIG. 2A, user 110 adopts a reclining position by leaning backwards in direction "x" with sufficient force so as to cause flexible chair spine 101 to bend backwards as shown. Chair 10 compensates for user 110's reclining posture. Specifically, chair back support 11 includes flexible chair spine 101, which adapts to user 110's spine curvature while also providing sufficient support to prop user 110 up and give proper support to user 110's spine. It should be noted that user 110's spine is slightly bent and flexible chair spine 101 adapts to that slightly bent configuration. In other words, flexible chair spine 101 not only supports user 110's back, it also conforms to the shape of user 110's back and keeps user 110's body upright. In this way, flexible chair spine 101 is configured to bend to the curvature of user 110's spine but remains stiff enough to support user 110's back.

It should be noted that, in embodiments of the invention, the flexibility described with respect to flexible spine 101 may be present throughout the length of flexible spine 101. For example, flexible spine 101 may be flexible in the section that supports the lower back of user 110, that supports the shoulder area of user 110, and that supports the head neck region of user 110. It should be appreciated, however, that in embodiments of the invention the extent of flexibility may vary from one section of flexible spine 101 to another. For example, the section of flexible spine 101 that supports the lower back of user 110 (connected to lower back support 104) may be less flexible than the section that supports user 110's shoulder (connected to shoulder support 103), which in turn may be less flexible than the section that supports user 110's head (connected to headrest 102). Further, any section of flexible section 101 may be configured to bend while other sections may not be able to bend. For example, the section of flexible spine 101 that supports user 110's shoulder (connected to shoulder support 103) may be configured to bend while other sections such as the section that supports the lower back of user 110 (connected to lower back support 104) is not able to be bent, or vice versa.

FIG. 2B shows chair 10 adapting to user 110's posture when user 110 leans forward. It should be noted that in FIG. 2B, user 110's spine is relatively straight and spine 101 adopts to this relatively straight configuration.

If user 110 moves from the posture shown in FIG. 2A to the posture shown in FIG. 2B, i.e. user 110 leans forward, spine 110 will contract (overall). The converse is true—if user 110 moves from the posture shown in FIG. 2B to the posture shown in FIG. 2A, i.e. user 110 leans backward, spine 110 will expand (overall). Thus, instead of a chair that is basically fixed and the user's body taking a posture that conflicts with the chair design (such as the chair back), as is the case with existing chairs, chair 10 conforms to user 110's posture. In other words, flexible chair spine 101 bends by expanding and contracting depending on the change in the shape of, and force applied by, a user's back on chair back support 11 of chair 10.

It should be appreciated that, in existing chairs, when the user leans backward, the back portion of such chairs do not bend. Instead, there may be a pivoting mechanism at the seat that allows the chair back as a whole to move backwards without the chair back itself bending. In other words, no portion of the back of such chairs move significantly, if at all, in relation to another part of the back or in relation to the seat. In contrast, as can be seen from FIGS. 2A and 2B, the shape of flexible chair spine 101 changes depending on the position and shape of the back of user 110. In this way, portions of flexible chair spine 101 move in relation to other portions of spine 101. Thus, bending or flexing of back support 11 or flexible spine 101 as described herein is different from tilting or pivoting of the back support as happens with existing chairs. The bending or flexing of back support 11 or flexible spine 101 includes an outer section 101*o* stretching and a corresponding inner section 101*i* compressing. It should also be noted that the bending occurs at a level higher than a level of the seat. This bending is different from mechanisms at the base of back support 11 that allows movement, such as tilting, of back support 11. Further, flexible spine 101 (and back support 11) moves in relation to seat 12. As such, for chair 10, a pivoting mechanism is not necessary in the area of seat 12, in order for user 110 to adopt a reclining position (or put chair 10 in a reclining position). It should be appreciated, however, that embodiments of the invention may include such pivoting mechanism.

User 110 may move from the posture shown in FIG. 2A to the posture shown in FIG. 2B, or vice versa (back support 11 and flexible spine 101 bending backwards and forwards) several times in a day. Because flexible chair spine 110 has a resistance mechanism (e.g. the 20-70 lbs required to bend flexible chair spine 101), user 110's back and forth movement allows user 110 to exercise his or her lower core throughout the day. As such, flexible chair spine 101, helps to strengthen user 110's core by virtue of flexible chair spine 101's flexibility that at the same time provides a predetermined resistance to movement. Muscles such as the erector spinae and quadratus lumborum (iliocostalis, spinalis, longissimus) are strengthened by these exercises. The erector spinae and quadratus lumborum muscles help maintain proper alignment of the spine. Weakness in these muscles leads to poor posture and back pain. These conditions may be prevented when a user uses chair 10 to exercise. Other muscle groups that are exercised as user 110 moves against the resistive force of flexible chair spine 101 include rectus abdominis, external and internal oblique's psoas, diaphragm, pelvic floor, hips, shoulders, and cervicle flexors.

Headrest 102, shoulder support 103 and lower back support 104 will move with the user's body during the use of chair 10 to exercise. As the user flexes, extends or rotates his or her body in chair 10, each of headrest 102, shoulder support 103 and back support 104 will move in conjunction with a corresponding body part (head and sections of back). This provides support to and lower pressure on any of the spinal segments. Further, it provides exercise for muscle along the full length of the three muscle groups of the spine as well as the intrinsic muscles between individual vertebra.

In embodiments, chair 10 may include a switch mechanism at pivot 111 that will allow user 110 to change the resistance provided by flexible chair spine 101. For example, a knob at pivot 111 may be rotated clockwise to reduce resistance in chair spine 101 and counter clockwise to increase resistance, or vice versa. The clockwise or counter clockwise movement of the knob controls tension wires 101*a* that run throughout chair spine 101. The knob may operate a pulley system to change the tension and could, for example, provide three or more resistance levels. Adjusting the tension of the tension wires 101*a* in chair spine 101 adjusts the flexibility of chair spine 101.

Shoulder support 103 is configured so that it molds to a user's body when the user sits in chair 10. The outer portion of shoulder support 103 may include a flexible back 103*a* (e.g. made of flexible plastic, memory foam and lycra) with an inner layer 103*b* that contacts the shoulder area of user 110 when user 110 is seated in chair 10. Inner layer 103*b* may be made of materials including but not limited to egg crate memory foam, nylon covering, gel, and the like. Inner layer 103*b* may be connected to flexible back 103*a* by materials such as glue etc. Further, inner layer 103*b* may be adapted to conform to a user's body. In this way, when user 110 sits in chair 10, shoulder support 103 will expand to the shape of user 110's upper back. This strengthens the core (stomach, hips and lower back). Raised contours 103*c* of shoulder support 103 may be made of foam or gel to promote proper erect posture with user 110's shoulders, back and chest when chair 10 is being used for seating support. When chair 10 is being used for exercises, raised contours 103*c* provides a gentle stretch of user 110's anterior shoulder and pectoral muscles and alignment of user 110's thoracic spine.

Lower back support 104 is configured so that it molds to a user's body when the user sits in chair 10. The outer portion of lower back support 104 may include a flexible back 104*a* (e.g. made of flexible plastic, Rynite, Hytrel and thermoplastic) with an inner layer 104*b* that contacts the lower back area of user 110 when user 110 is seated in chair 10. Inner layer 104*b* may be made of materials including but not limited to egg crate memory foam, nylon covering, gel and the like. Inner layer 104*b* may be connected to flexible back 104*a* by materials such as glue etc. Inner layer 104*b* may be made of material adapted to conform to a user's body. In this way, when user 110 sits in chair 10, lower back support 104 will expand to the shape of user 110's lower back. This strengthens the core (stomach, hips and lower back).

Lower back support 104 and shoulder support 103 may also be made of memory plastic that molds to user 110's body when user 110 sits into chair 10. The memory plastic material is adapted to expand and contract. It expands when user 110 sits in chair 10 and contracts when user 110 gets out of chair 10. It should be noted that headrest 102 (if included), shoulder support 103 and lower back support 104 may be provided as one element attached to flexible chair spine 101 instead of the separate elements attached to flexible chair spine 101 as shown. It should also be noted that chair back support 11 could be one contiguous element (including sections covered by headrest 102, shoulder support 103 and lower back support 104) that is flexible as described with respect to flexible spine 101.

In embodiments, the flexibility in flexible chair spine 101 is not only with respect to backwards and forwards movement as depicted in the difference in its orientation in FIGS. 2A and 2B. Rather, flexible chair spine 101 may also be flexible so as to allow user 110 to rotate left to right when seated in chair 10. In other words, user 110 can turn clockwise and counterclockwise, pivoting from the hip so that flexible chair spine 101 flexes (rotates) as the back of user 110, while resting on chair back support 11, is rotated (twisted) to the left or right. In this way, chair back support 11 has sufficient flexibility in flexible chair spine 101 to provide a mechanism for user 110 to exercise back, core and surrounding muscles by rotating (twisting) the upper body from left to right, pivoting from the hip, as shown in FIGS. 3A-3C and 4A. This exercise feature is in addition to or an alternative to the exercise feature provided by the backwards and forwards movement described above with respect to FIGS. 2A and 2B.

It should be noted that in existing chairs a left to right twisting (rotating) motion of the upper body, as described above, would cause the seat and chair back to rotate together in the direction of the rotating motion. This is the swiveling motion of existing chairs. In embodiments of the invention, the swiveling feature may be present but there also may be mechanisms to make it inactive when user 110 desires to use flexible spine 101 to do the above described rotation exercises. In embodiments of the invention, however, chair back support 11 rotates clockwise or counter-clockwise (right or left) without seat 12 rotating clockwise or counter-clockwise (right or left). In this way, the resistance provided by flexible chair spine 110 when it is being rotated by user 110's upper body, provides exercise to user 110's back and core muscles. During the rotation motion of user 110's upper body, the agonistmon side of the body contracts and antagonist side resists the motion back to a neutral position.

Figure 3A:
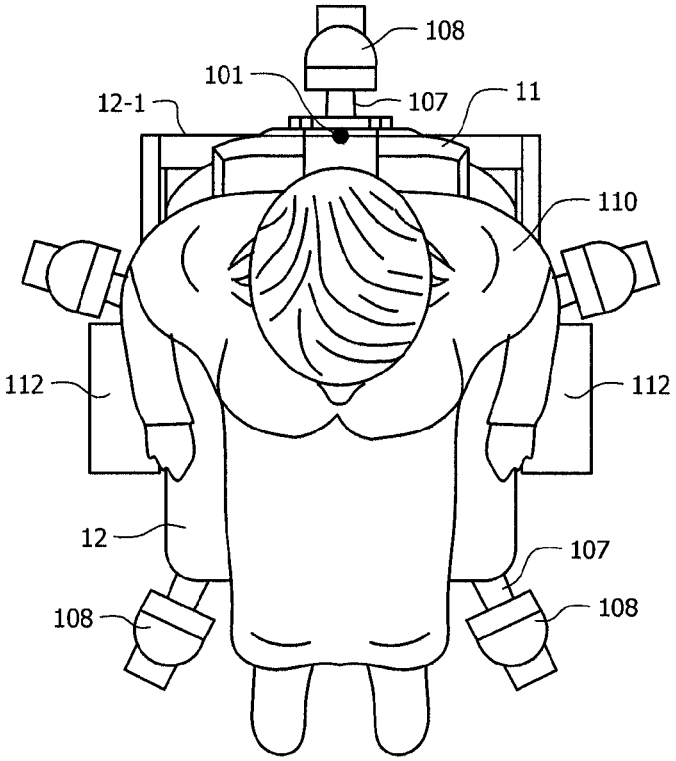
FIGS. 3A-3C show a chair according to embodiments of the invention.
Figure 3B:
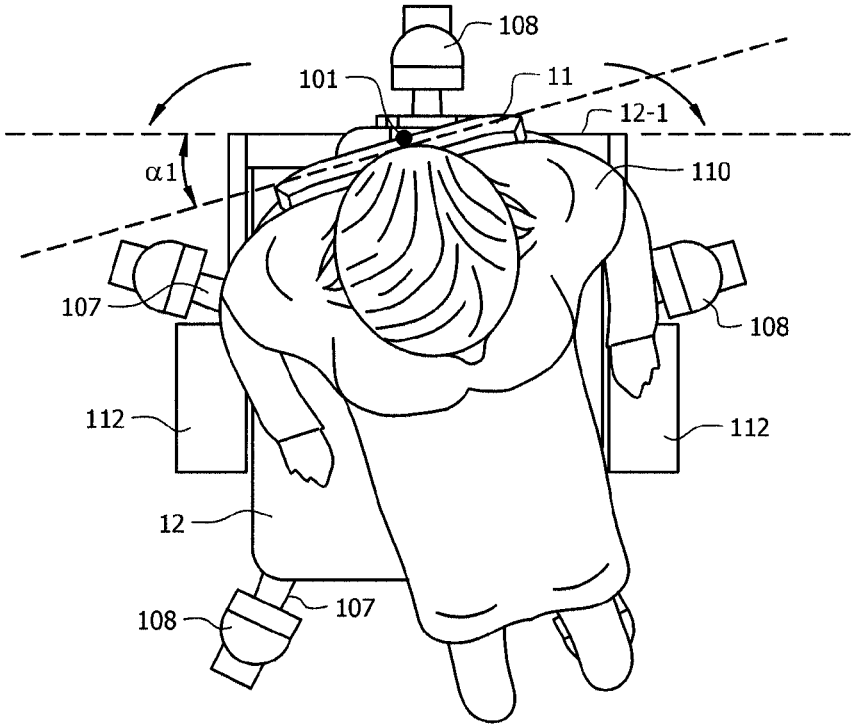
Figure 3C:
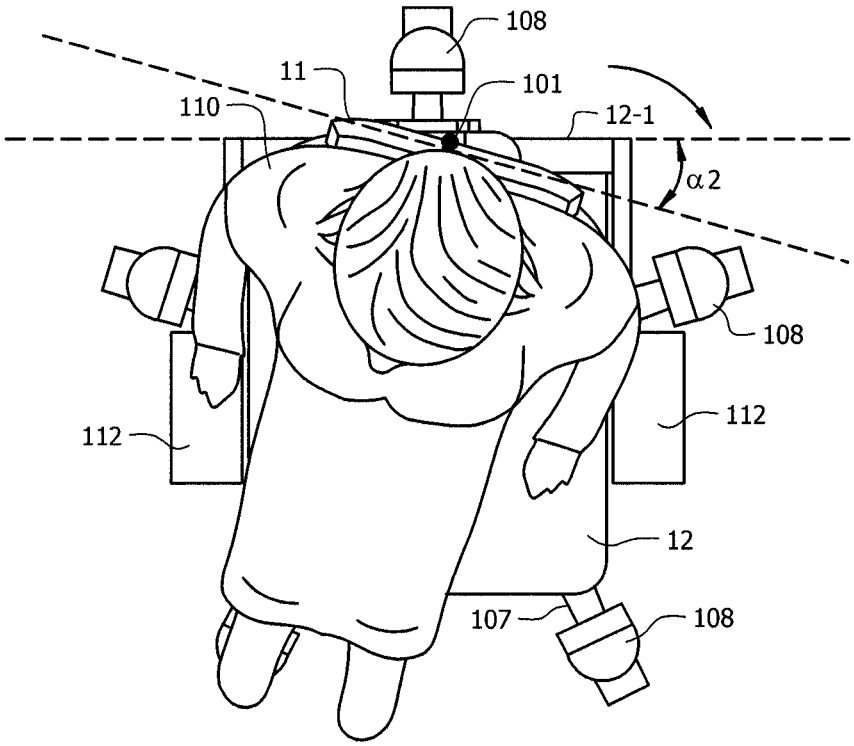

FIGS. 3A-3C show a plan view of chair 10 and the clockwise movement and counter clockwise movement of back support 11 about flexible chair spine 10 respectively. FIG. 3A shows chair 10 is at its normal rest position, in which user 110 is not applying a rotating force to chair back support 11. In FIG. 3B, user 110 rotates to her left in an anti-clockwise motion. In FIG. 3C, user 110 rotates to her right in a clockwise motion. As shown, chair back support 11 adapts to a new position with respect to seat 12 when the rotating force is applied. For example, at rest (FIG. 3A) chair back support 11 and side 12-1 are substantially in the same vertical plane or substantially in parallel planes. In FIGS. 3B and 3C, chair back support 11 and side 12-1 are in different vertical planes (or not substantially in the same vertical plane). In FIG. 3B, chair back support 11 and side 12-1 are at an angle $\alpha 1$ with each other. In FIG. 3C, chair back support 11 and side 12-1 are at an angle $\alpha 2$ with each other. In embodiments of the invention, the force necessary to cause the rotation of chair back support 11 in a clockwise or counter clockwise direction is 20-70 lbs. In some embodiments, the force is limited to 20-40 pounds.

FIGS. 1A and 1B show chair 10 also includes handles 105. Handles 105 provide support for user 110 to rest his or her arms on. Handle 105 may be substantially horizontal in a plane above seat 12 (at a higher level) and to the left or right of seat 12. Handle 105 may include memory arm pad 112 to relieve pressure on user 110's forearm. This is an ergonomic feature. When user 110 rests his or her arm on arm rests 112, arm rest 112 relieves pressure points on user 110's arm and promotes healthy circulation in the arms. The end of arm rest 112 may have a notch/grip for user 110 to hold during exercises. The notch/grip may also be used as a stabilization point for stretching to relieve/prevent carpal tunnel, golfer elbow and tennis elbow. In some instances, handles 105 may prevent user 110 from pulling chair 10 as close to a desk as user 110 may desire. To equip handles 105 with the flexibility of providing proper ergonomic support and allow chair 10 to be pulled close to a desk without hindrance from handles 105, handles 105 may be adapted so that their positions can be changed in relation to the other components of chair 10. For example, handles 105 may be adapted so that they can be flipped backwards (rotated backwards around a pivot) when desired. This feature allows handles 105 to be moved to a position in which they are no longer a hindrance to moving the chair close to the desk.

Figure 4A:
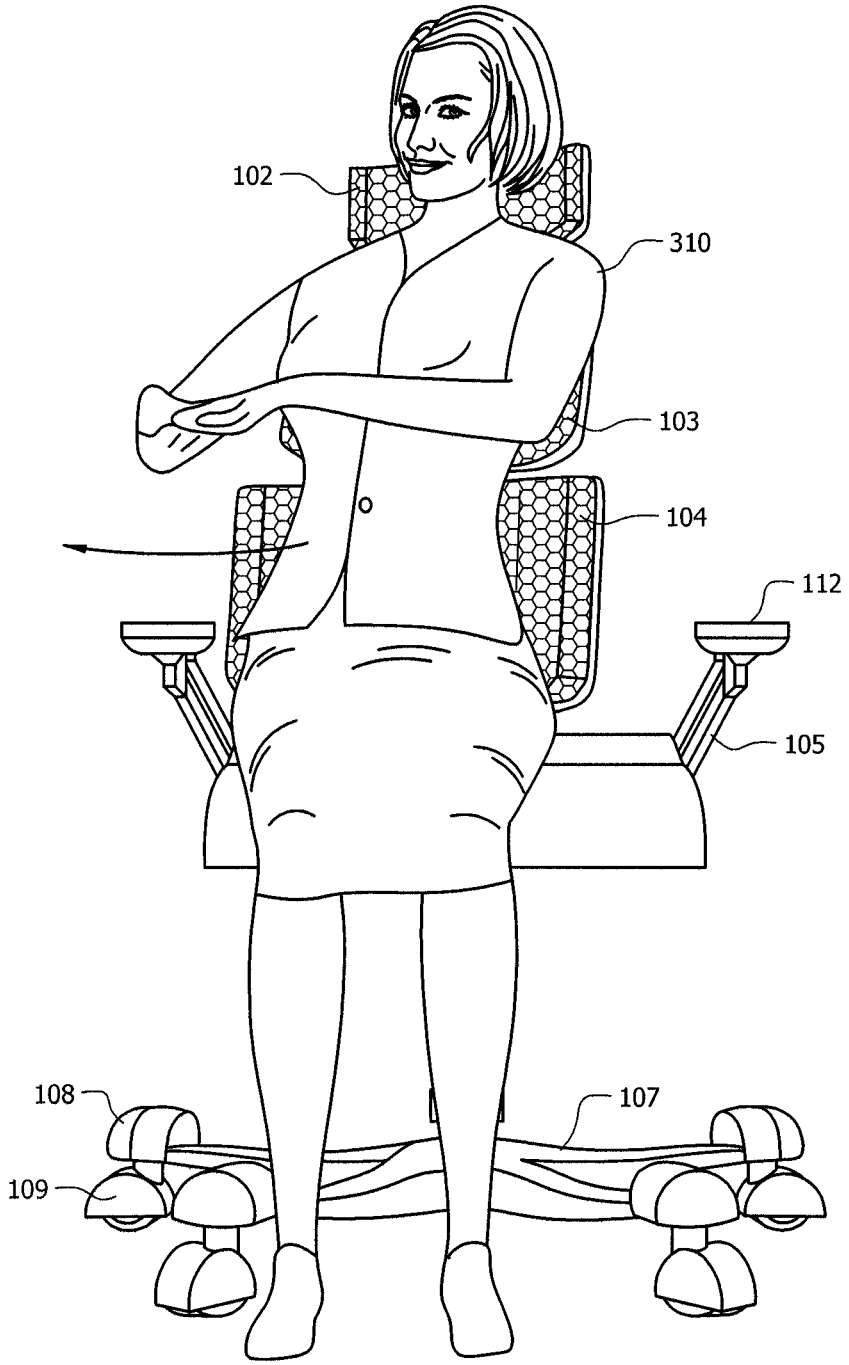
FIGS. 4A-4E show a chair according to embodiments of the invention.
Figure 4B:
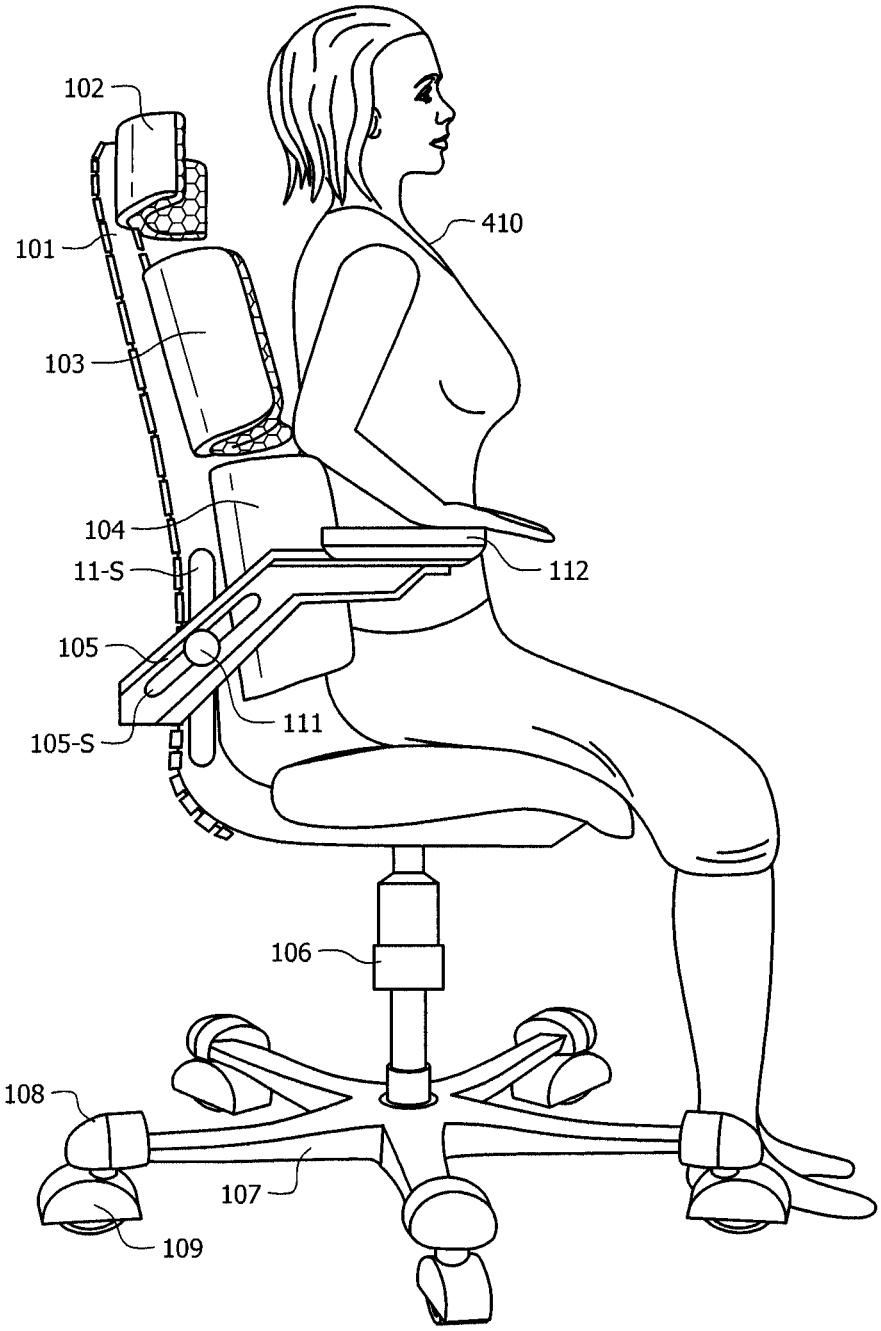
Figure 4C:
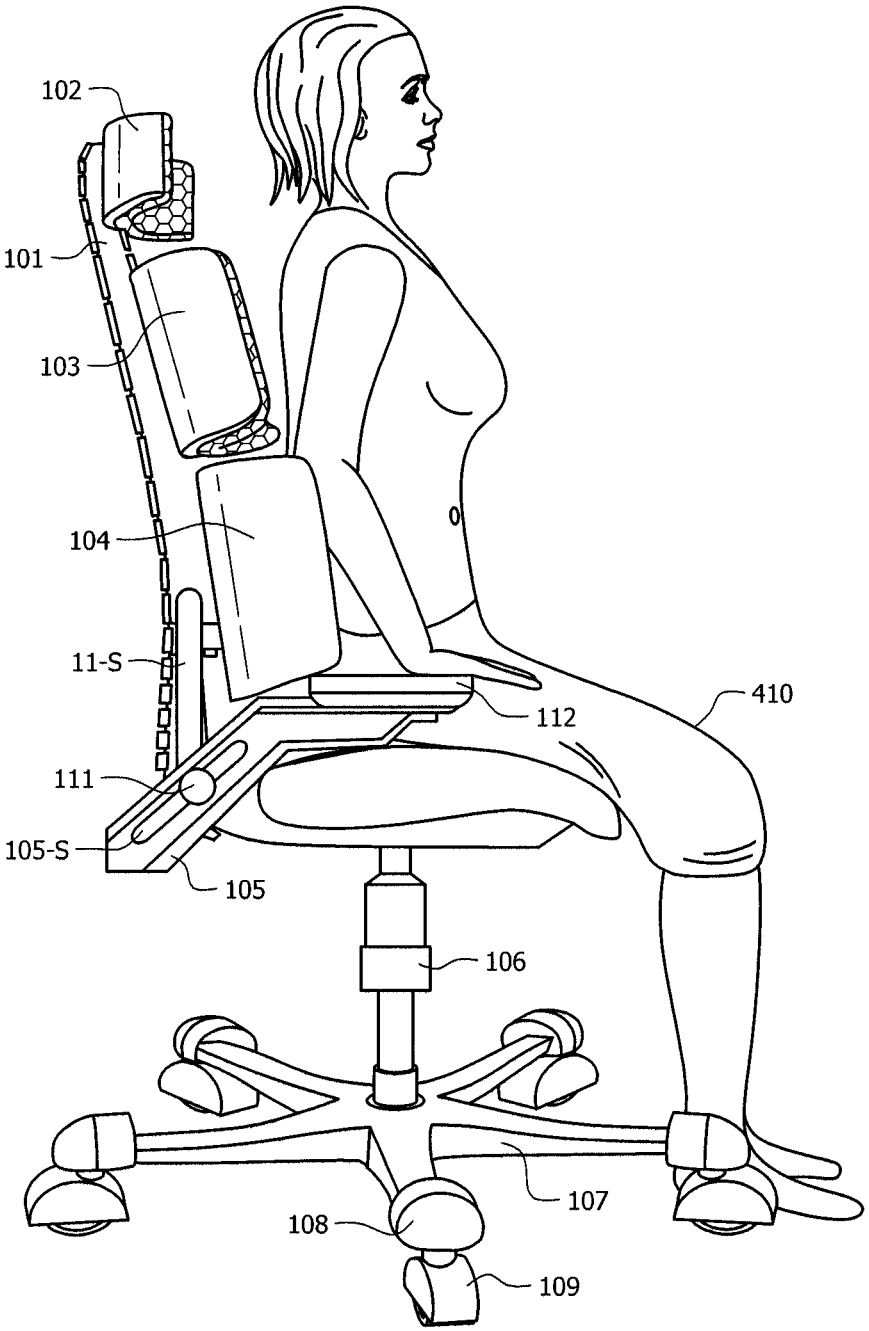
Figure 4D:
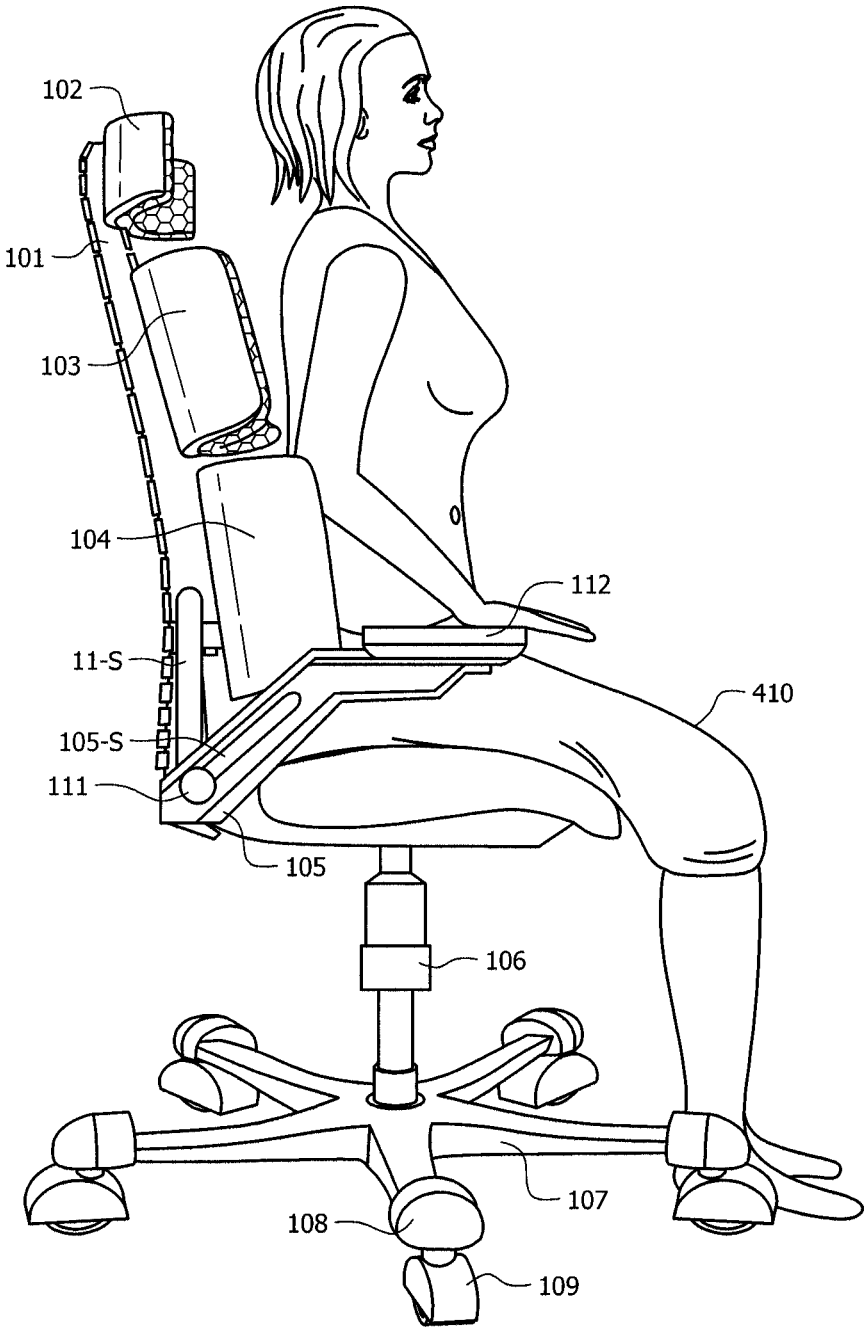
Figure 4E:
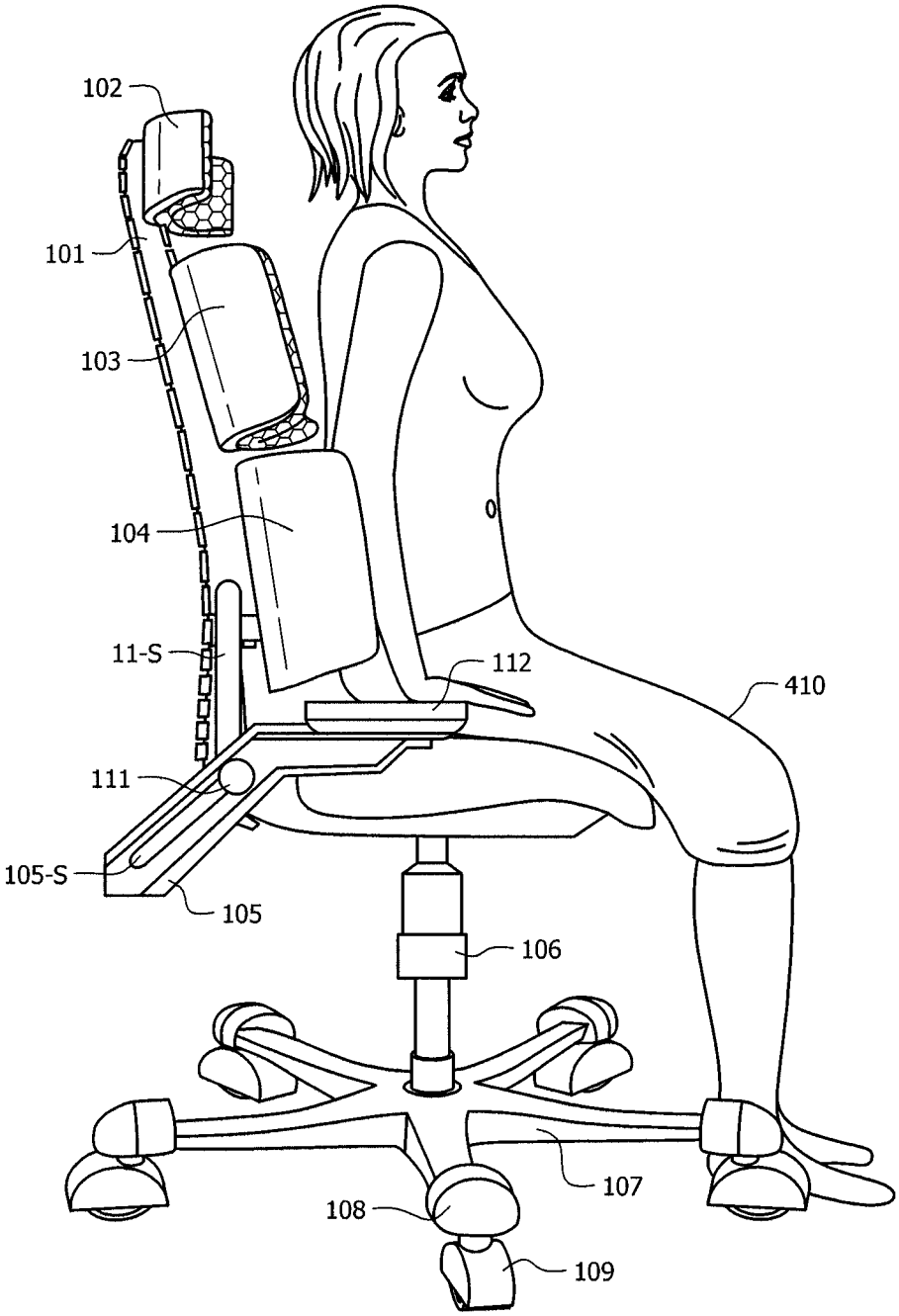
Figure 5:
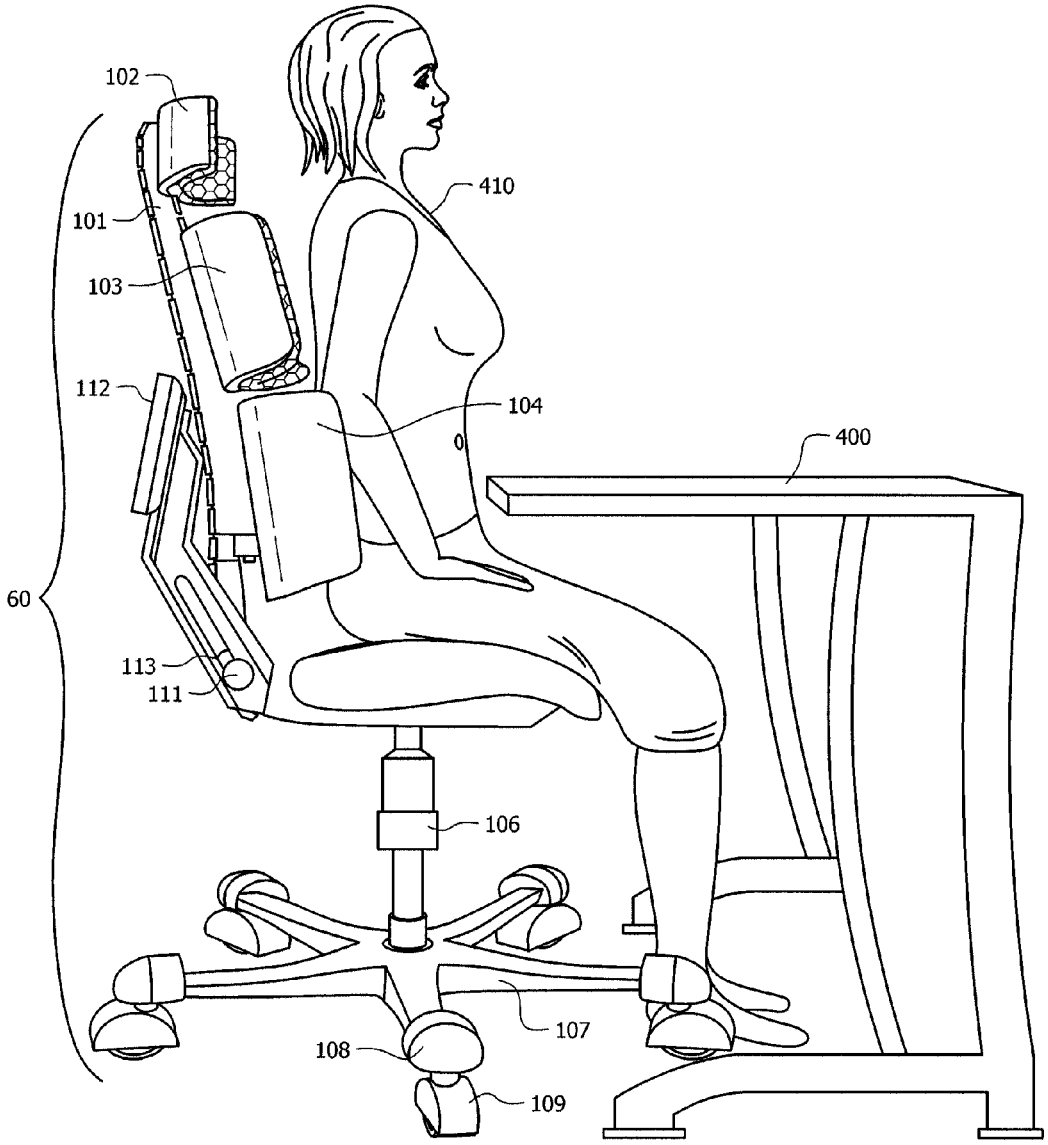
FIG. 5 shows a chair according to embodiments of the invention.

FIG. 5 illustrates how handles 105 may be moved (pivoted) backwards towards chair back support 11 and away from desk 400, so that chair 10 can be moved closer to desk 400 as compared with the scenario in which handles 105 are in their normal position for providing arm support. In FIG. 5, a pivot 111, located in the area where chair back support 11 and seat 12 are connected, allows handles 105 to be flipped up from a horizontal position to a vertical, near vertical or some other position other than the normal hand rest position and locked into place by a mechanism such as a latch. In other words, handles 105 pivot around pivot 111. Turning to FIGS. 4D and 4E, handle 105 has slot 105-*s* in which pivot 111 is disposed. As such, handle 105 can be moved up or down by sliding handle 105 over pivot 111 such that pivot 111's position in slot 105-*s* changes as a result of movement of handle 105. Pivot 111 may have a resistance mechanism associated with it.

It should be appreciated that other methods of moving handle 105 so that it is not a hindrance in moving chair 10 closer to desk 400 may be implemented. For example, handle 105 may be designed so that it may be lowered or raised to a height different from the height of desk 400. In embodiments, chair back support 11 may have a slot 11-*s* in which pivot 111 also fits (FIGS. 4B and 4C). Pivot 111 may be moved up or down in slot 11-*s*. In this scenario, handle 105 may be locked onto pivot 111 so that as pivot 111 moves vertically within slot 11-*s*, handle 105 also moves vertically up or down. Depending on which of the features are being implemented with respect to handles 105, pivot 111 may operate as a pivot, as an element connected to handle 105 to guide the movement of handle 105 or as a bolt over which a slot of handle 105 may move.

Handles 105 may be configured such that they provide a mechanism for user 110 to exercise his or her biceps and triceps muscles. For example, handles 105 may be configured such that they move downwards in response to the application of a downward force from user 110's arm (such as described with respect to FIGS. 4B to 4E). A resistive force provided by handle 105 to this downward force from user 110's arms provides the mechanism for user 110 to exercise his or her biceps or triceps muscles. The resistive force provided by handles 105 can be provided by different types of mechanisms. The mechanisms may include pulley systems, elastic cable, coil of springs, hydraulic mechanisms, pneumatic mechanisms, the like and combinations thereof. Without the downward force from user 110's arms, handles 105 may revert upwards to its normal rest position.

FIGS. 4B-4E show user 110 using chair 10 and handles 105 for exercising user 110's biceps and triceps muscles. User 110 pushes against the resistive upward force provided by handles 105. In embodiments, handles 105 can be further configured so that to get handles 105 back to their original positions, where they serve as hand rests, user 110 has to apply an upward pulling or lifting force to handles 105. In this way, the exercise function is achieved by user 110 working against resistive forces in both upward and downward directions. Thus, throughout the day, user 110, when it is convenient, can carry out repetitions of pushing down and pulling up action on handles 105 to get exercise while in the office. The mechanisms that provide the resistive force may include pulley systems, elastic cable, coil of springs, hydraulic mechanisms, pneumatic mechanisms, the like and combinations thereof. In embodiments of the invention, the resistive force for the arm exercises may be about 10-40 lbs.

It should be appreciated that an exercise function may be provided by allowing handles 105 to provide resistive force in other directions. For example, an inward resistive force towards user 110's side in response to user 110 moving handles 105 outwards to the side away from his or her body may be provided. Further, an outward resistive force away from user 110 in response to user 110 moving handles 105 inwards to the side may also provide further exercise function. The mechanisms that provide the resistive force may include pulley systems, elastic cable, coil of springs, hydraulic mechanisms, pneumatic mechanisms, the like and combinations thereof.

Figure 6:
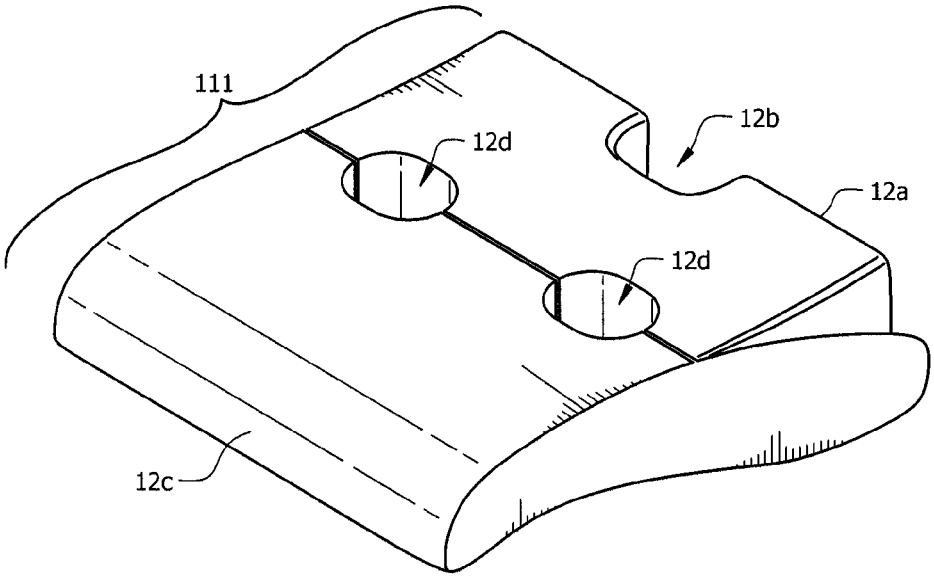
FIG. 6 shows a seat according to embodiments of the invention.

FIGS. 1A and 1B show chair 10 including seat 12. Seat 12 may be made of materials including memory foam, gel and nylon elastic outer fabric. Seat 12 may be connected to chair back support 11 by, for example, a plate and nuts and bolts. However, different methods may be used to connect seat 12 to chair back support 11 for example, welding and V connect. FIG. 6 shows seat 12, which includes wedge 12*a* and a cutout section 12*b*. Wedge 12*a* provides seat 12 with a sloping wedge shape at the section of seat 12 that connects to chair back support 11. The slope created by this wedge shape is a downward slope from back support 11 towards water fall edge 12*c* (the front of seat 12). Because of this slope an obtuse angle exists between the surface of seat 12 and back support 11. In its position, wedge 12*a* directly provides support to user 110's spine. This configuration helps to correctly align the spine of user 110. Wedge 12*a* tilts user 110's pelvis forward when user 110 is seated in chair 10 and ensures the natural lumbar curve of user 110's spine is maintained. Also, having seat 12 with wedge 12*a* at the section of seat 111 that directly supports user 110's spine causes user 110's hip flexor muscles to relax and thereby prevent slouching.

Implementing the wedge shape in a chair seat may cause the user's tailbone to be irritated by pressure from the wedge. Thus, according to embodiments of the invention, cutout section 12*b* eliminates pressure on the tailbone. User 110's spine would be directly above cutout section 12*b* when user 110 sits in chair 10. As such, there is no upward force on user 110's tailbone, which is at the end of user 110's spine. In other words, there is a gap in the support provided at the upper surface of seat 12, which comes into contact with user 110's buttocks when user 110 sits in chair 10. Similarly, indentations 12*d* provides pressure relief for the ischial tuberosities (bones within the pelvis). Indentations 12*d* may be implemented as a gap like cutout section 12*b*.

It should be appreciated that the gap in support may be provided in additional or alternative ways in embodiments of the invention. For example, the upper surface may be made to appear as having a continuous surface with a covering over a cut out portion. The covering alone would not be able to provide sufficient force to irritate user 110's tailbone or ischial tuberosities. Another method may include using material, in the gap in support, that provides less upward force than the materials used in other sections of seat 12. For example, gel material may be used in seat 12 generally but at cutout section 12*b* and 12*d*, material such as memory foam may be used. This material provides minimal upward force against user 110's tail bone. Different memory foams may have different densities. Memory foam with low density causes less pressure. Memory foam is rated by indention load deflection (ILD) from 10 (soft) to 16 (firm). Seat 12 includes about an inch of firm foam at the bottom and a softer top layer. Gaps in support may have softer ILD (less than 10).

Seat 12 may also include a waterfall edge 12*c* at the front (away from chair back support 110) which promotes healthy blood circulation in user 110's body. Overall, the combinations of the features of the wedge with the gaps in support and the wedge with the gaps in support and the waterfall provide user 110 with an ergonomic seat support.

A common exercise people use to build core muscles is balancing on an exercise ball. An exercise ball is a large inflated ball on which people sit and try to maintain their balance as they sit. Some offices have included these exercise balls in their office space. An exercise ball in an office space, however, raises several concerns. For example, it presents a safety concern because one can fall from the ball. Further, some people consider it a distraction when other employees are using the exercise balls.

Figure 7A:
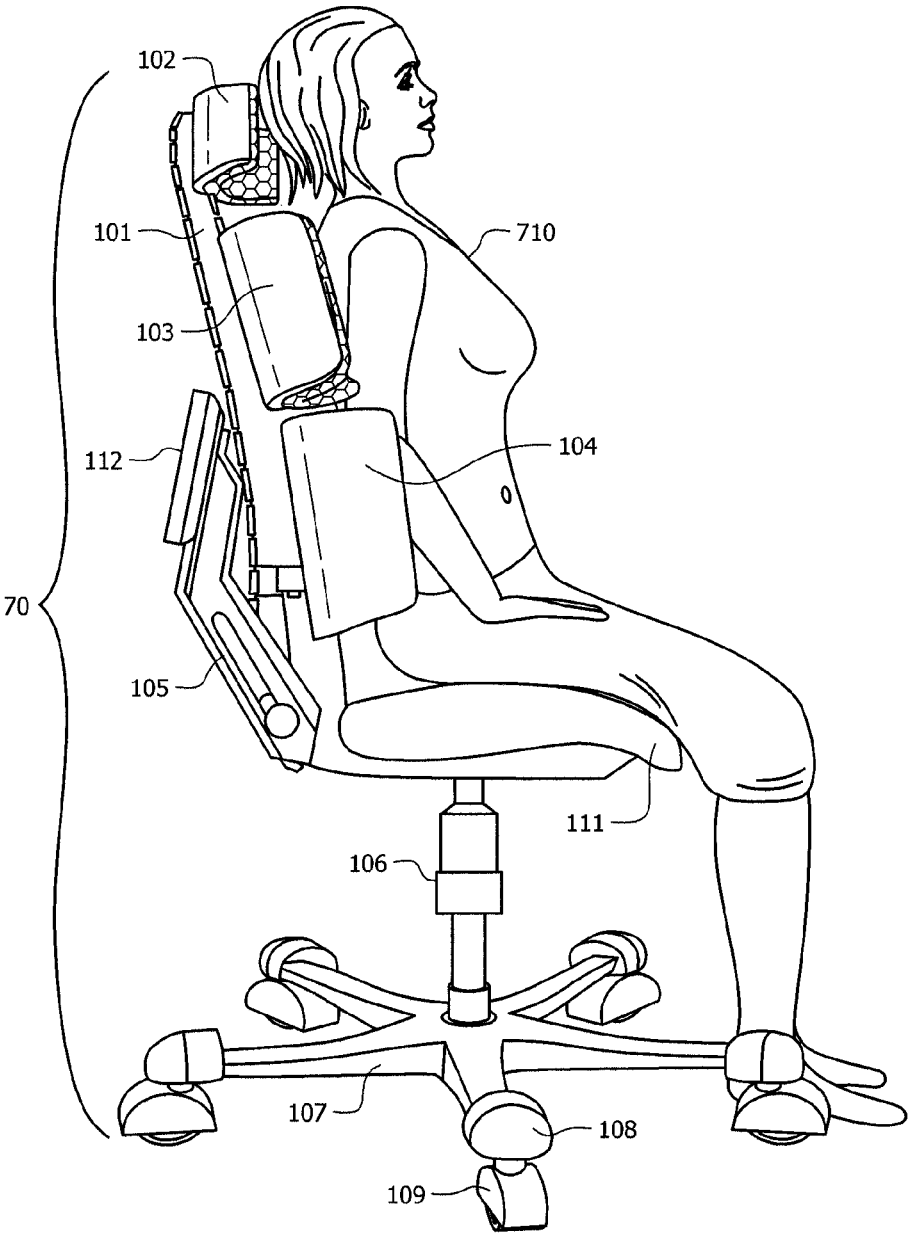
FIGS. 7A and 7B show a chair according to embodiments of the invention.

FIG. 7A shows chair 10 having a seat that includes a mechanism to simulate sitting on a ball. Handles 105 are flipped up from the sides of chair 10 and located in a position behind chair back support 11, as shown in FIG. 5, so that they do not interfere with the exercise. Seat 12 is configured to provide support to user 110 in a small area in the center of seat 12. Outside of this small area there is no support provided to user 110 unless seat 12 tilts about 2-3 inches downwards, at which point support is provided such that user 110 will not fall off chair 10. This simulates sitting on a ball. In other words, chair 10 is wobbly up to 2-3 inches downwards in areas outside of the center of seat 12 that provides support. In this way seat 12 is adapted to provide support only at seat 12's center of gravity such that user 110 has to balance on seat 12 at its center of gravity in order to keep seat 12 in a horizontal position. A switch switches chair 10 from its normal function to one in which user 110 has to balance himself or herself on seat 12.

Figure 7B:
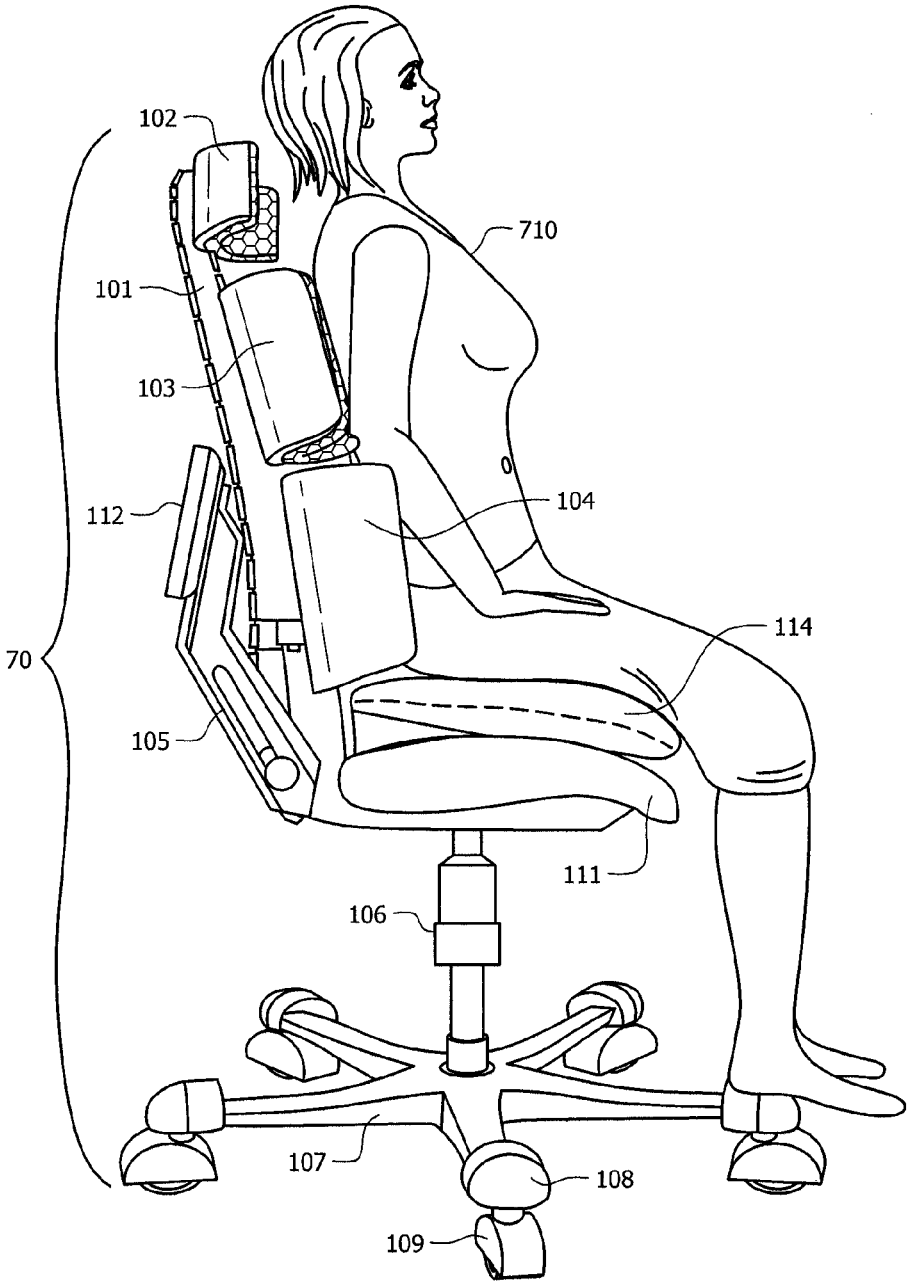
Figure 8A:
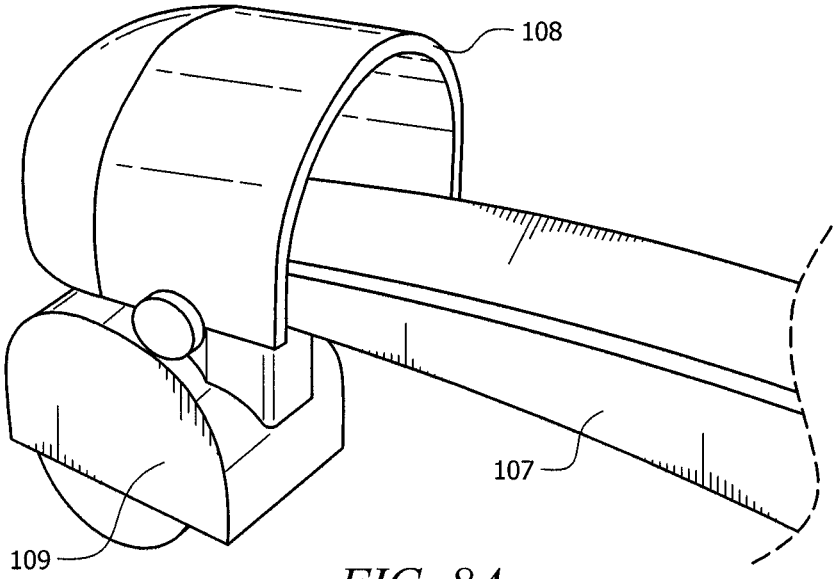
FIGS. 8A and 8B show foot anchors according to embodiments of the invention.
Figure 8B:
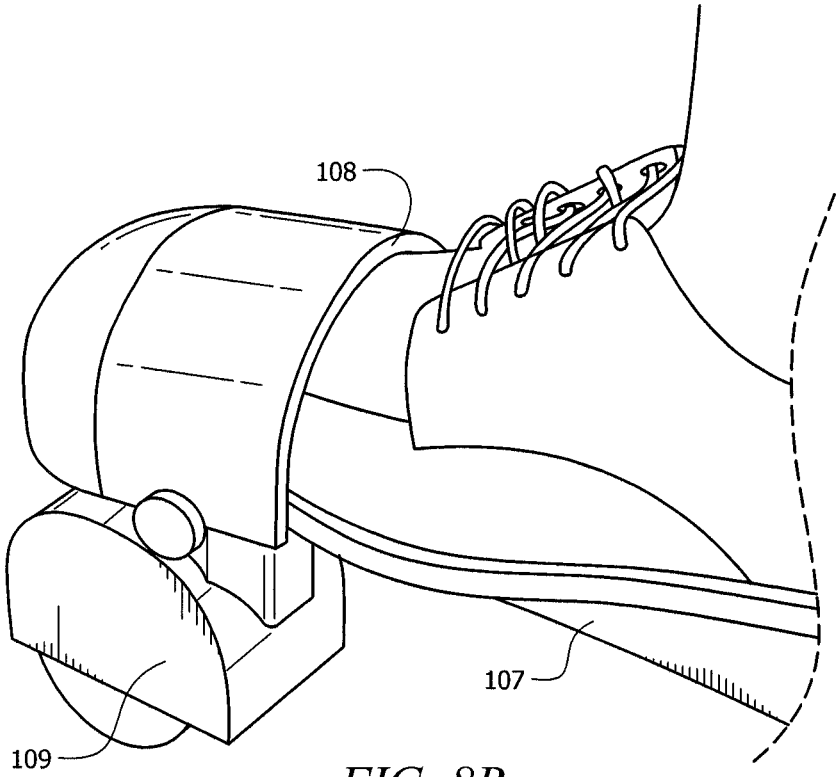

FIG. 7B shows cushion 114 that may also be used to simulate sitting on a ball. Cushion 114 has a button at the bottom of it that can be used to attach and detach cushion 114 to seat 11. The button on the cushion is attached to another button on the top surface of seat 111. Cushion 114 is a component that can be connected to chair 10 by a button or Velcro. User 110 can use cushion 114 to balance as is done with inflatable balls. By doing this, user 110 will exercise lower back and core muscles by repeatedly tightening and relaxing these muscles in an effort to balance of cushion 114.

FIGS. 1A and 1B show that below seat 11 is base 13 for supporting seat 12 and chair back support 11. Base 13 may be made of metal (such as powder coated aluminum), plastic, composites etc. and combinations thereof. Base 13 may include a pedestal 106 for connecting seat 12 to foot 107. Pedestal 106 may be configured such that its height can be adjusted and thereby change the height of chair 10 for proper positioning with respect to a particular desk height, for performing an exercise or for relaxing in the chair.

Foot 107 in embodiments of the invention may be a five-star base as shown in FIGS. 1A and 1B. Located on each prong of the base is caster 109. Casters 109 may be made of hard plastic and mounted on base 13 to enable chair 10 to be easily moved. Casters 109 may include a braking or locking function to prevent chair 10 from moving, when desired. The brake feature may be achieved in various ways including providing a lever that presses the brake against the wheel of the caster. A rotational lock may also be used to prevent the wheels from rotating. The braking and locking feature may be used, for example, when user 110 is performing exercises using chair 10. It should be appreciated that embodiments of the invention may be implemented with bases of different designs. For example, embodiments may not include casters or the five-star base. Indeed, an alternative base could include four legs each attached to the lower surface of seat 12.

FIGS. 1A and 1B show base 13 including foot anchors 108 (foot restraint). Foot anchors 108 allow user 110 to anchor his or her feet during exercises performed with chair 10. Foot anchors 108 are affixed to the prongs of foot 107. Anchors 108 are configured such that user 110 can insert the toe section of his or her feet into anchors 108, which holds the feet and provide support while user 110 is exercising (FIG. 9). In other words, user 110 can use his or her feet to brace against foot anchors 108 during exercises in which one's legs and feet need to be stationary and to help user 110 balance properly on chair 10. Anchors 108 may be utilized by user 110 during any of the exercises described herein.

Figure 9A:
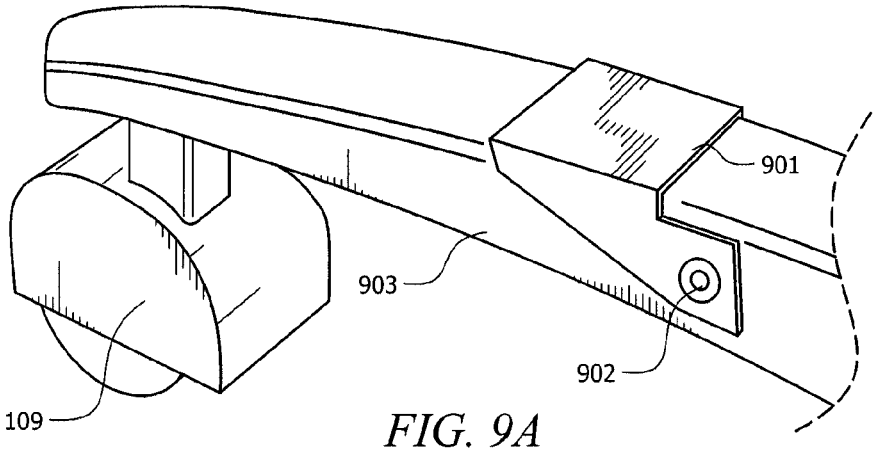
FIGS. 9A and 9B show foot anchors according to embodiments of the invention.
Figure 9B:
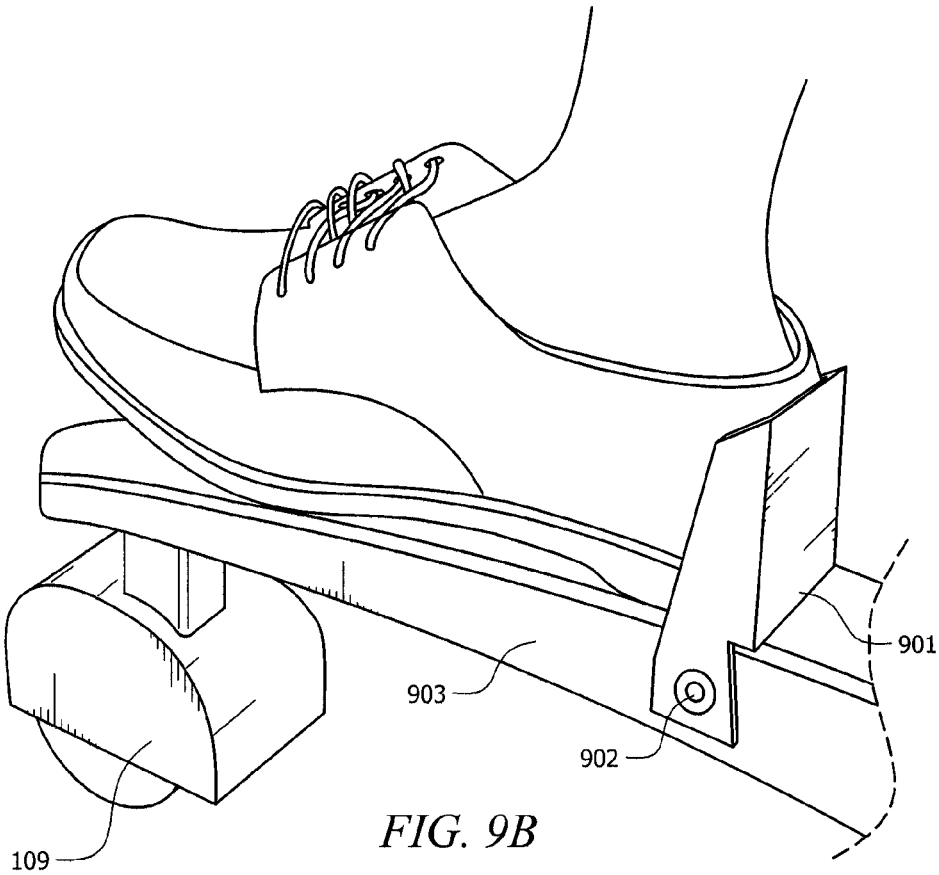

It should also be noted that foot anchors in embodiments may include providing support to the heels of user 110's foot, alternative to or in addition to, providing support via the toes of use 110's foot. FIGS. 9A and 9B show foot anchors (foot restraints) 901 that provide support to the heel of user 110's foot. As used herein, a toe anchor is a foot anchor in which a user inserts the toe section of his or her foot for support and a heel anchor is a foot anchor in which a user inserts his or heel for support. In FIG. 9A, foot anchor 901 is not in use and thus lies horizontal and flush with prong 903 of foot 107. To put foot anchor 901 in the use position, user 110 can flip foot anchor 901 from its horizontal position into a vertical position as shown in FIG. 9A such that user 110 can insert his or her heel into foot anchor 901. Foot anchor 901 may have pivot 902 to facilitate the movement of foot anchor 901 from the position shown in FIG. 9A to the position shown in FIG. 9B. Pivot 902 may be configured such that it locks foot anchor 901 into the positions shown in FIGS. 9A and 9B but a force applied by user 110 can release these locked positions.

Figure 10:
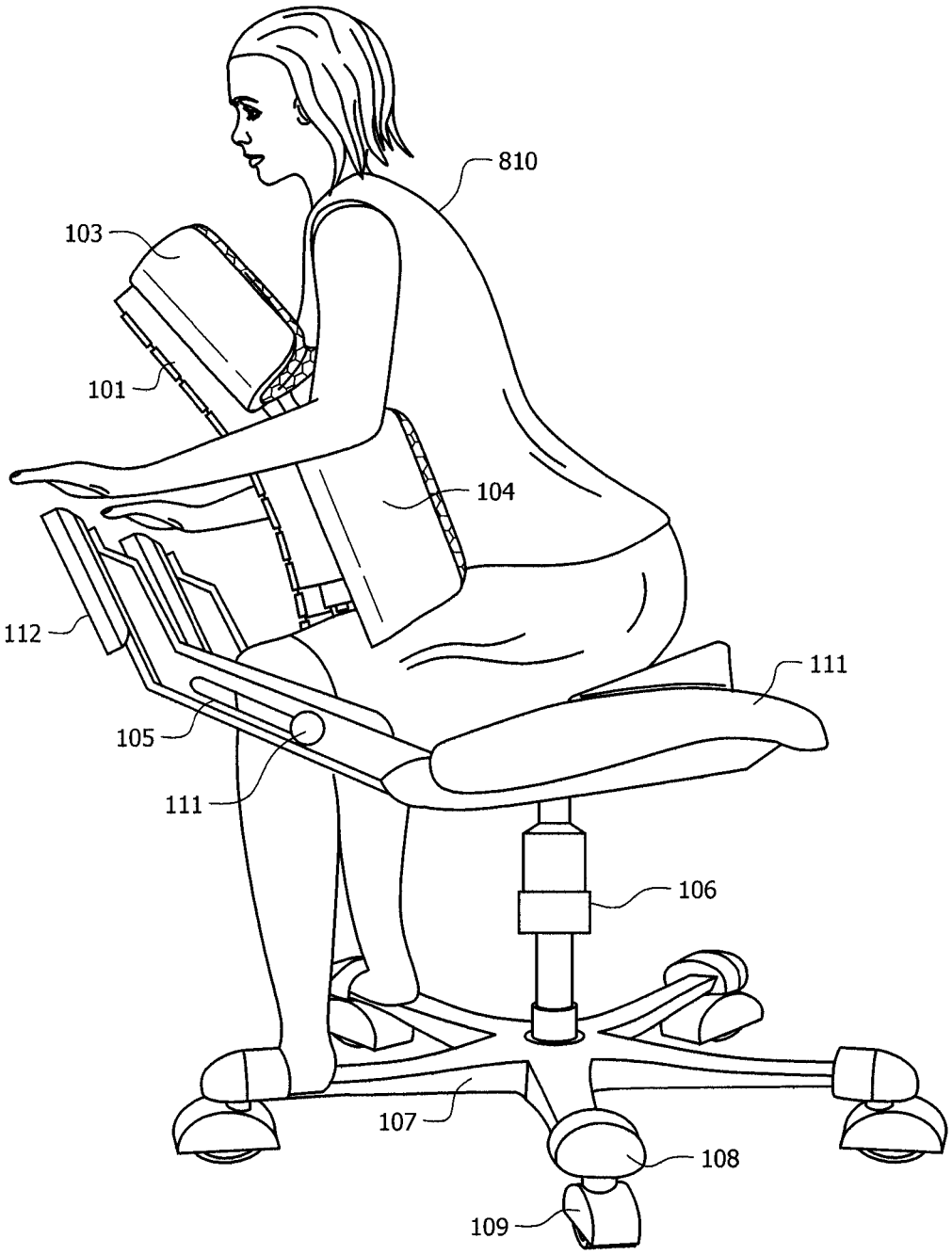
FIG. 10 shows a chair according to embodiments of the invention.

FIG. 10 shows chair 10 being used by user 110 to do exercises while user 110's seating position is reversed from the normal seating position. Instead of resting her back on back support 104 and shoulder support 103, user 110 rests her abdomen and chest on back support 104 and shoulder support 103. In this embodiment, headrest 101 may be absent or it may be removable. The removable feature allows headrest 101 to be present when chair 10 is used for sitting as shown in FIGS. 2A and 2B but removable when chair 10 is to be used to do exercises as shown in FIG. 10. The removable feature may be provided in several ways such as by a screw and thread mechanism, a piston and slot mechanism and the like.

As shown in FIG. 10, there is sufficient space between back support 104 and seat 12 for user 110 to fit her thighs in this space. Also, wedge 12*a* may be detachable from seat 12 so it can be placed as shown in FIG. 9 to support user 110's spine at an opposite end of seat 12. In this position, in which user 110 sits on chair 10 backwards, user 110 can use the resistance provided by flexible chair spine 101 to perform an exercise by pressing her chest against shoulder support 103. User 110 then releases that pressing force to allow spine 101 to move back to its normal position. These actions may be repeated such that user 110 and chair back support 11 moves back and forth. This exercise allows user 110 to exercise core and back muscles.

Further, arms 105 may be rotated around pivot 111 (flipped upward and backward) so that they rest in a position behind chair back support 11 and in front of user 110 as shown in FIG. 10. In this position, a further exercise may be performed by user 110 pushing down on the underside of arms 105. A resistive force opposes user 110's pushing action. The opposing resistive force may be provided by mechanisms such as pulley systems, elastic cable, coil of springs, hydraulic mechanisms, pneumatic mechanisms, the like and combinations thereof. The resistive force may be such that arms 105 returns to a rest position if no pushing force is applied to it. Alternatively, the resistive force mechanism may be configured so that a force is required to push handles 105 into a new position and an opposite force is required to pull it out of that position. In this way, user 110 can exercise several muscles (including biceps and triceps) by carrying out the back and forth, pushing and pulling action. It should be noted that in embodiments of the invention, arms 105 may be rotated 360° around pivot 111 and locked into various different positions within the 360° rotation. From any of these locked positions (e.g. latched positions) a resistive force resists movement into another position. When unlatched, however, arms 105 can be rotated easily.

Embodiments of the invention include methods that manufacture any of the chairs with features described herein. For example, embodiments of the invention include a method including manufacturing a chair that has a seat; a back support connected to the seat, and a foot connected to a lower face of the seat as described herein. For example, the back support may be manufactured so that it has a flexible spine.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A chair for supporting a user, said chair comprising:

a seat; and a back support connected to said seat, said back support comprising:

a flexible chair spine that provides flexibility substantially throughout its length due to its material composition;

a lower back support surface that is connected to said chair spine at a level higher than a level of said seat and is adjacent to a portion of the user's lumbar spine; and a shoulder support surface that is connected to the flexible chair spine at a level higher than a level of said seat and is adjacent to a portion of the user's thoracic spine;

wherein said flexible chair spine and each of said support surfaces are capable of flexing in response to force from said user against said support surfaces, and wherein said flexible chair spine is capable of flexing in at least two axes of motion of said user at each of said support surfaces.

2. The chair of claim 1 wherein said back support bends in a manner such that an outer side of said back support is stretched and an inner side of said back support is compressed when said force is applied to said back support and further configured so that said back support is restored to an original position when said force is removed.

3. The chair of claim 1 wherein said back support is configured to adapt to a curvature of said user's spine when said user is seated in said chair.

4. The chair of claim 1 wherein said chair spine comprises a plastic material.

5. The chair of claim 1 wherein said chair spine comprises a carbon fiber material.

6. The chair of claim 1 wherein said back support rotates from an original position in relation to said seat when a rotating force is applied to said back support and further configured so that said back support is restored to the original position when said rotating force is removed.

7. The chair of claim 1 wherein a resistance of said chair spine is adjusted with a switch mechanism.

8. The chair of claim 1 wherein each of said support surfaces are capable of independently flexing in response to said forces from said user.

9. The chair of claim 1 further comprising:

arm rests, wherein a first arm rest is disposed substantially horizontal and is located substantially in a vertical plane to a left side of said seat and a second arm rest is disposed substantially horizontal and is located substantially in a vertical plane to a right side of said seat, said arm rests adapted to be movable downwards by a user against an upward resistive force.

10. The chair of claim 9 wherein said arm rests are adapted to be released from said substantially horizontal position so that they can rotate 360° around a pivot disposed at a back of said seat.

11. The chair of claim 10 wherein said arm rests are adapted to be latched into a new position within the 360° rotation.

12. The chair of claim 1 wherein said support surfaces are directly connected to said chair spine and are capable of independently flexing in response to said forces from said user.

13. The chair of claim 1 wherein an upper surface of said seat comprises gaps in support provided to said user, wherein said gaps in support include gaps in support beneath said user's spine and beneath said user's ischial tuberosities, wherein said upper surface of said seat slopes downwards from said back support.

14. The chair of claim 1 wherein an upper surface of said seat slopes downwards from said back support.

15. The chair of claim 14 wherein there is an obtuse angle between said upper surface and said back support.

16. The chair of claim 1 wherein said seat is adapted to be adjusted to provide support only at said seat's center of gravity such that said user has to balance on said seat at said center of gravity in order to keep said seat in a horizontal position.

17. A chair for supporting a user, said chair comprising:

a seat;

a flexible chair spine that provides flexibility in at least two axes of motion of said user due to its material composition;

a lower back support surface that is connected to said chair spine at a level higher than a level of said seat and is adjacent to a portion of the user's lumbar spine;

a shoulder support surface that is connected to the flexible chair spine at a level higher than a level of said seat and is adjacent to a portion of the user's thoracic spine; and said seat is connected to said flexible chair spine; said seat comprising an upper surface that comprises gaps in support provided to said user, wherein said gaps in support include gaps in support beneath said user's spine and beneath said user's ischial tuberosities, wherein said upper surface of said seat that includes said gaps that supports said user slopes downwards from said flexible chair spine to a forward portion of the seat;

wherein said lower back support surface is adjacent to said seat and engages with the user to push a user's pelvis forward from said flexible chair spine on said upper surface.

18. The chair of claim 17 wherein at least one of said gaps in support comprises a space in said upper surface.

19. The chair of claim 17 wherein at least one of said gaps in support comprises material in said upper surface that provides less upward force against said user's spine or ischial tuberosities than a surrounding material in said upper surface.

20. The chair of claim 17 wherein at least one of said gaps in support comprises material adapted such that said gap in support provides less upward force against said user's spine or ischial tuberosities than upward forces provided by other areas of said seat to said user's body that is resting on said upper surface.

21. The chair of claim 17 wherein said support surfaces are directly connected to said chair spine and are capable of independently flexing in response to said user.

22. The chair of claim 17 wherein said chair spine comprises a plastic material.

23. The chair of claim 17 wherein said seat is adapted to be adjusted to provide support only at said seat's center of gravity such that said user has to balance on said seat at said center of gravity in order to keep said seat in a horizontal position.

24. A chair for supporting a user, said chair comprising:

a seat; and a back support connected to said seat, said back support comprising:

a chair spine that is flexible at least at a lower back pad and at a shoulder back pad due to its material composition and is shaped to adapt to a curvature of said user's spine;

said lower back pad that is connected to a bottom portion of said chair spine; and said shoulder back pad that is connected to a portion of said chair spine that is higher than said connection to said lower back pad;

wherein said chair spine is capable of flexing in at least two axes of motion of said user in response to force from said user against each of said back pads.

25. The chair of claim 24 wherein said back support is configured so that, when a rotating force is applied to said back support, said back support is rotated from an original position in relation to said seat and further configured so that, when said rotating force is removed, said back support is restored to the original position.

26. The chair of claim 24 wherein said back pads are capable of independently flexing in response to said forces from said user.

27. The chair of claim 24 wherein a resistance of said chair spine is adjusted with a switch mechanism.

28. The chair of claim 24 further comprising:

arm rests, wherein said arm rests are adapted to be movable downwards, by said user, against an upward resistive force.

29. The chair of claim 24 further comprising:

arm rests, wherein said arm rests are adapted to move rotationally around a pivot disposed at a back of said seat.

30. A chair for supporting a user, said chair comprising:

a seat having an upper surface that comprises gaps in support provided at said upper surface to said user, wherein said gaps in support are adapted to be beneath said user's spine and ischial tuberosities when said user is seated in said chair with said user's back resting on a back support of said chair, wherein said upper surface of said seat that includes said gaps that supports said user slopes downwards from said back support to a forward portion of the seat;

said back support comprising:

a chair spine that is flexible at least at a lower back support surface and at a shoulder support surface in at least two axes of motion of said user due to its material composition and is connected to said seat, said chair spine configured to bend to a curvature of said user's spine when said user is seated in said chair, said flexible chair spine is further configured such that said user can rotate said back support by rotating said user's upper body against said back support when said user is seated in said chair, said lower back support surface that is connected to a bottom portion of said chair spine, wherein said lower back support surface engages with the user to push a user's pelvis forward from said chair spine on said upper surface of said seat;

said shoulder support surface that is connected to said chair spine at a level higher than said connection of said lower back support surface; and arm rests, wherein said arm rests are adapted to be movable downwards against an upward resistive force.

31. The chair of claim 30 wherein said seat is adapted to be adjusted to provide support only at said seat's center of gravity such that said user has to balance on said seat at said center of gravity in order to keep said seat in a horizontal position.

* * * * *